United States Patent [19]

Hancock et al.

[11] 4,253,208

[45] Mar. 3, 1981

[54] BOX SPRING ASSEMBLY WITH BASIC WIRE GRID

[75] Inventors: William L. Hancock, Lexington; John P. Kitchen, Georgetown; Ned W. Mizelle, Lexington, all of Ky.

[73] Assignee: Hoover Universal, Inc., Saline, Mich.

[21] Appl. No.: 63,903

[22] Filed: Aug. 6, 1979

[51] Int. Cl.[3] ..... A47C 23/04; A47C 23/05

[52] U.S. Cl. ..... 5/247; 5/267; 5/478

[58] Field of Search ..... 5/247, 255, 267, 476, 5/478, 479, 260, 263

[56] References Cited

U.S. PATENT DOCUMENTS

| | | | |
|---|---|---|---|
| 795,661 | 7/1905 | Staples | 5/267 |
| 1,717,949 | 6/1929 | Stubnitz | 5/478 |
| 4,112,528 | 9/1978 | Higgins | 5/267 |
| 4,120,059 | 10/1978 | Cavaler | 5/256 |

*Primary Examiner*—James T. McCall
*Assistant Examiner*—Alexander Grosz
*Attorney, Agent, or Firm*—Olsen and Stephenson

[57] ABSTRACT

A box spring assembly which includes a generally rectangular frame and a wire spring assemblage mounted on the top side of the frame; the assemblage including a large number of straight wires arranged criss-cross fashion and arcuate springs that support and connect the straight wires at some of the points of intersection. A basic wire grid is formed with downwardly extending hook portions that snap over some of the spring wires to secure the grid to the assemblage so as to bridge the spaces between the straight wires. The "spring back" capability of the spring wires allows them to spring into the hook portions so as to retain the grid in position.

7 Claims, 4 Drawing Figures

BOX SPRING ASSEMBLY WITH BASIC WIRE GRID

BACKGROUND OF THE INVENTION

This invention relates generally to mattress foundation structures and more particularly to a box spring assembly of a type which utilizes non-coil springs. Box spring assemblies of this general type have been know since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; 3,852,838; and 4,131,961. Box spring assemblies of the general type shown in the above list of patents, all of which are assigned to the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly, and cost of manufacture.

Additional box spring assemblies of this general type are shown in U.S. Pat. Nos. 3,596,299; 3,722,013; 3,825,960; 3,833,948; 3,835,485; 3,869,740; 3,990,121; and 4,000,531.

The present invention provides a box spring assembly which utilizes a basic wire grid in combination with a wire spring assemblage in a manner that enables the use of fewer springs, assures the desired uniform support for a mattress, and simplifies the assembly of the grid with the spring assemblage.

It is an object of the present invention, therefore, to provide an improved box spring assembly in which a basic wire grid is combined with a wire spring assemblage that includes individual springs arranged to achieve a desired degree of mattress support.

SUMMARY OF THE INVENTION

The box spring assembly of this invention consists of a rectangular frame having side rails, end rails, and a plurality of cross rails that are generally parallel and are substantially perpendicular to the side raills. A wire spring assemblage, formed of high carbon heat treated spring steel wire, is mounted on the frame. The spring assemblage includes a plurality of wire springs mounted on the cross rails and connected to each other so as to yieldably resist downwardly directed bedding loads. Each of the springs has a body comprised of two side-by-side arcuate portions that are upright and will bend in substantially vertical planes to provide yieldable resistance to loads.

The arcuate portions are formed integral at their upper ends with a pair of torsion bars located so that the torsion bars in each spring body are in substantially the same horizontal plane and are spaced horizontally. The upper ends of the spring body portions overlap and a connecting bar, which extends between the torsion bars, is positioned generally between the upper ends of the arcuate portions. The small size of the spring enables the use of a few or many of the springs in a box spring assembly, depending upon strength, stiffness, and cost requirements.

The spring assemblage also includes a large number of straight wires arranged above the frame in a criss-cross fashion in which some of the wires are substantially parallel and spaced apart horizontally in one direction and other wires are substantially parallel and spaced apart horizontally in another direction substantially parallel to the first direction to thereby form a generally horizontal spring wire deck spaced above the frame and having a continuous arrangement of rectangular spaces formed by the straight wires. At some of the points of intersection of the wires, the wires are secured by conventional clips to the torsion and connecting bars in the springs. Thus, the sizes of the rectangular spaces bounded by the straight wires are to some extent limited by the number and location of the springs. In the illustrated form of the invention, the springs are spaced on the frame so that the rectangular spaces are of uniform size. It is to be understood that this uniformity is not essential and it is within the purview of this invention to arrange the springs so that the spaces are of non-uniform size.

Box spring units in which the top wire deck on which the mattress is supported have large openings are objectionable because they provide non-uniform support for the mattress. It is a matter of judgment as to the maximum size spaces that can be tolerated without adversely affecting sleeping comfort, but it is generally agreed that smaller size spaces are preferred.

In the box spring assembly of this invention a grid unit, formed of basic low carbon steel wire that has not been heat treated and is lacking in the "springiness" that characterizes spring wire and is thus less expensive, is combined with the wire spring assemblage. The grid unit in the present invention comprises a plurality of straight first wires that are substantially parallel to some of the deck wires and are spaced apart horizontally and a plurality of horizontally spaced straight second wires that are perpendicular to the first wires and are substantially parallel to the other deck wires. The grid wires are secured to each other, preferably by welding, to form the grid unit and are located so that they bridge the spaces in the deck in mutually perpendicular directions. Some of the grid unit wires have downwardly extending return bent-upon-themselves hook portions at their ends and these hook portions are snapped over the deck wires which are readily sprung to positions in clearance relation with the hook portions and then confined therein. The deck wires then cooperate with the hook portions to restrain the grid unit against horizontal shifting movement on the deck.

The result is a box spring assembly that can be economically manufactured and assembled and which will provide a desired uniformly yieldable foundation for a mattress. The provision of the basic wire grid enables the manufacture of the box spring assembly of this invention with fewer springs and deck wires, which are formed of the more expensive spring steel, while still providing the desired uniform support for the mattress.

Further objects, features, and advantages of this invention will become apparent from a consideration of the following description, the appended claims, and the accompanying drawing in which:

Figure 1:
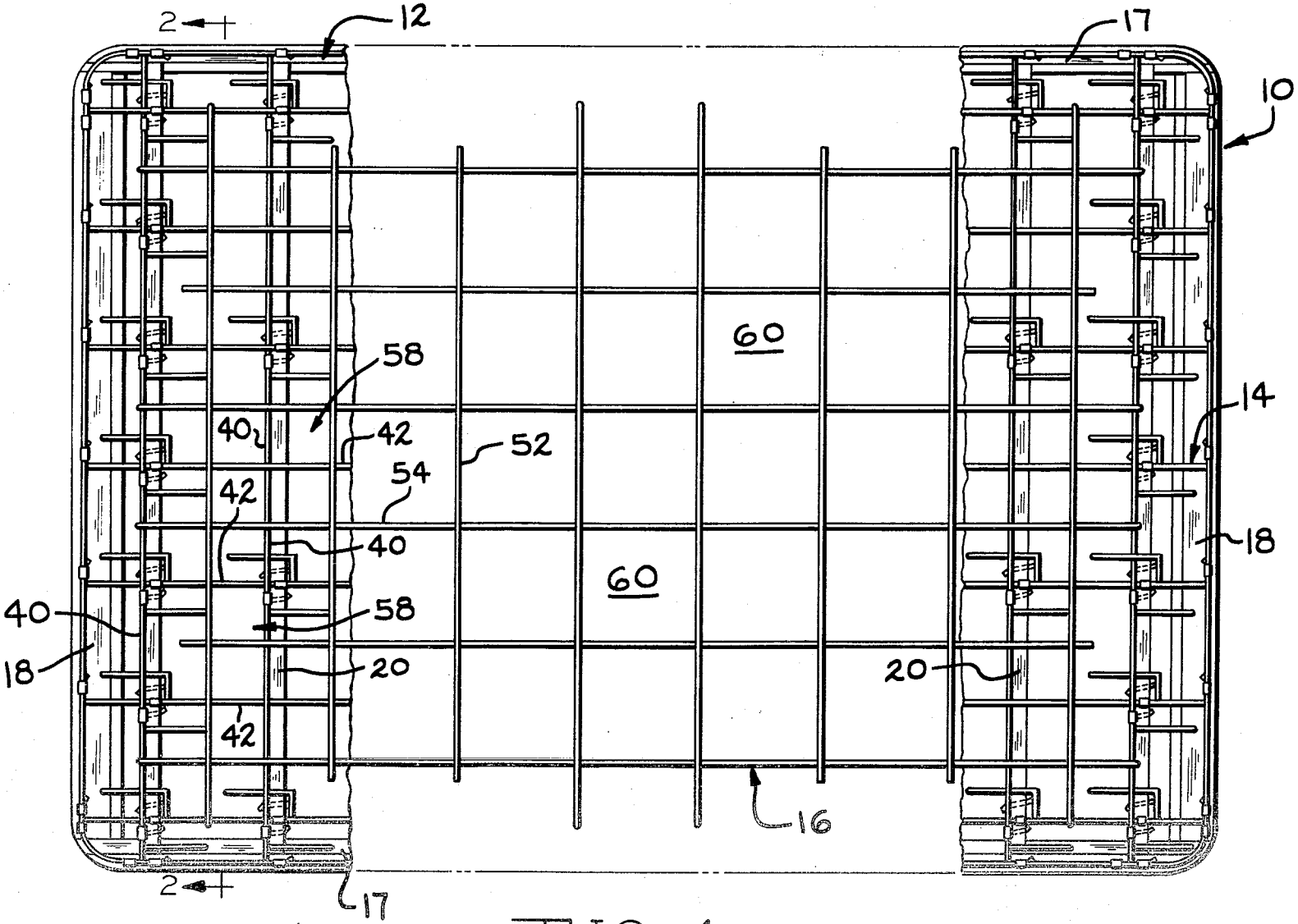
FIG. 1 is a plan view of the box spring assembly of this invention.

With reference to the drawing, the box spring assembly of this invention, indicated generally at 10, is illustrated in FIG. 1 as consisting of a generally rectangular, horizontally disposed frame 12, a wire spring assemblage 14 mounted on the top side of the frame 12, and a wire grid 16 mounted on the top side of the spring assemblage 14. The frame 12 has side rails 17 and end rails 18 which are usually formed of wood, and a plurality of generally parallel cross rails 20, illustrated as being formed of metal (FIG. 3), secured to and extending between the side rails 20 (FIGS. 2 and 3) are formed with spring mounting slots 22 for a purpose to be described in greater detail hereinafter. It is to be understood that wooden cross rails can be used as an alternative to the illustrated metal cross rails 20.

The spring assemblage 14 consists of a plurality of springs 24 and a wire deck 25 supported on and secured to the upper ends of the springs 24.

Each of the springs 24 is formed from a length of spring steel wire bent to form a body 26 having a pair of upright arcuate portions 28 which are arranged side by side and are formed at their lower ends with mounting feet 30. The springs 24 are described in detail in copending application Ser. No. 064,050, filed 08/06/1979. The structure of the feet 30 and their interaction with the cross rail slots 22 so as to mount the springs 24 on the frame 12 are well known and are described in detail in prior U.S. Pat. No. 3,680,157, referred to above.

The arcuate portions 28, in the preferred form of the present invention, are generally semi-circular in shape, although it is to be understood that it is within the purview of the present invention to use other arcuate shapes, the portions 28 in each spring 24 being extended at their upper ends to provide for the overlap of upper end sections 29. By "overlap", it is meant that a vertical plane can be passed through the body 26 which will intersect both arcuate portions 28 at their upper ends.

A torsion bar 32 is formed integral with the top end of each spring portion 28 and is arranged so that it extends toward the top end of the other spring portion 28. The torsion bars 32 are disposed in a common, horizontal plane and are connected by a connecting bar 34 that is generally perpendicular to the torsion bars 32.

The wire deck 25 consists of a plurality of first generally parallel, horizontally spaced straight wires 40 and a plurality of other straight wires 42 which are generally perpendicular to the wires 40 and are also spaced apart horizontally.

Figure 2:
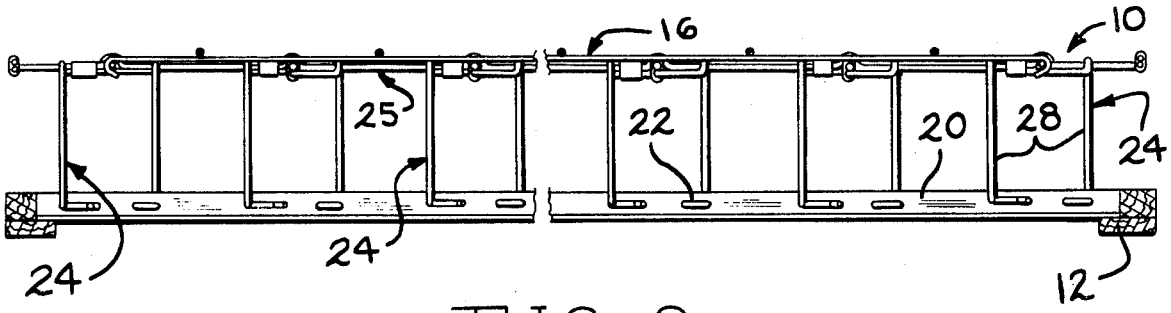
FIG. 2 is a transverse sectional view of the box spring assembly of this invention, with a central portion of the assembly removed.
Figure 3:
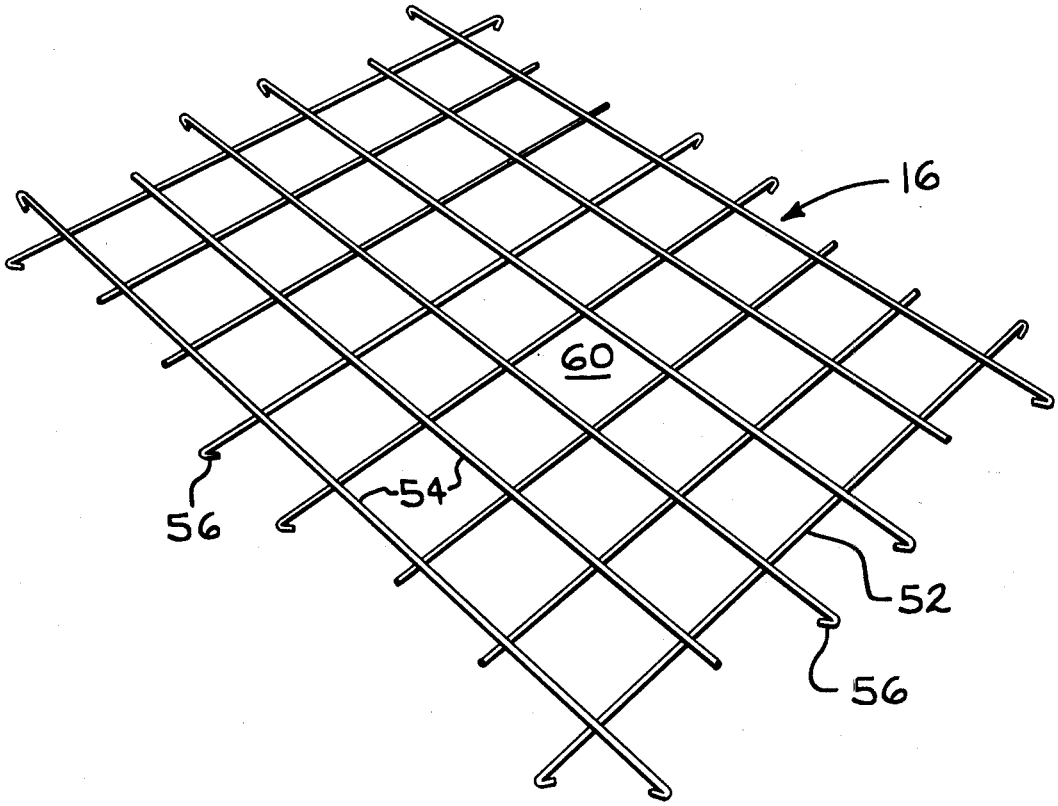
FIG. 3 is a perspective view of the wire grid unit in the box spring assembly of this invention.
Figure 4:
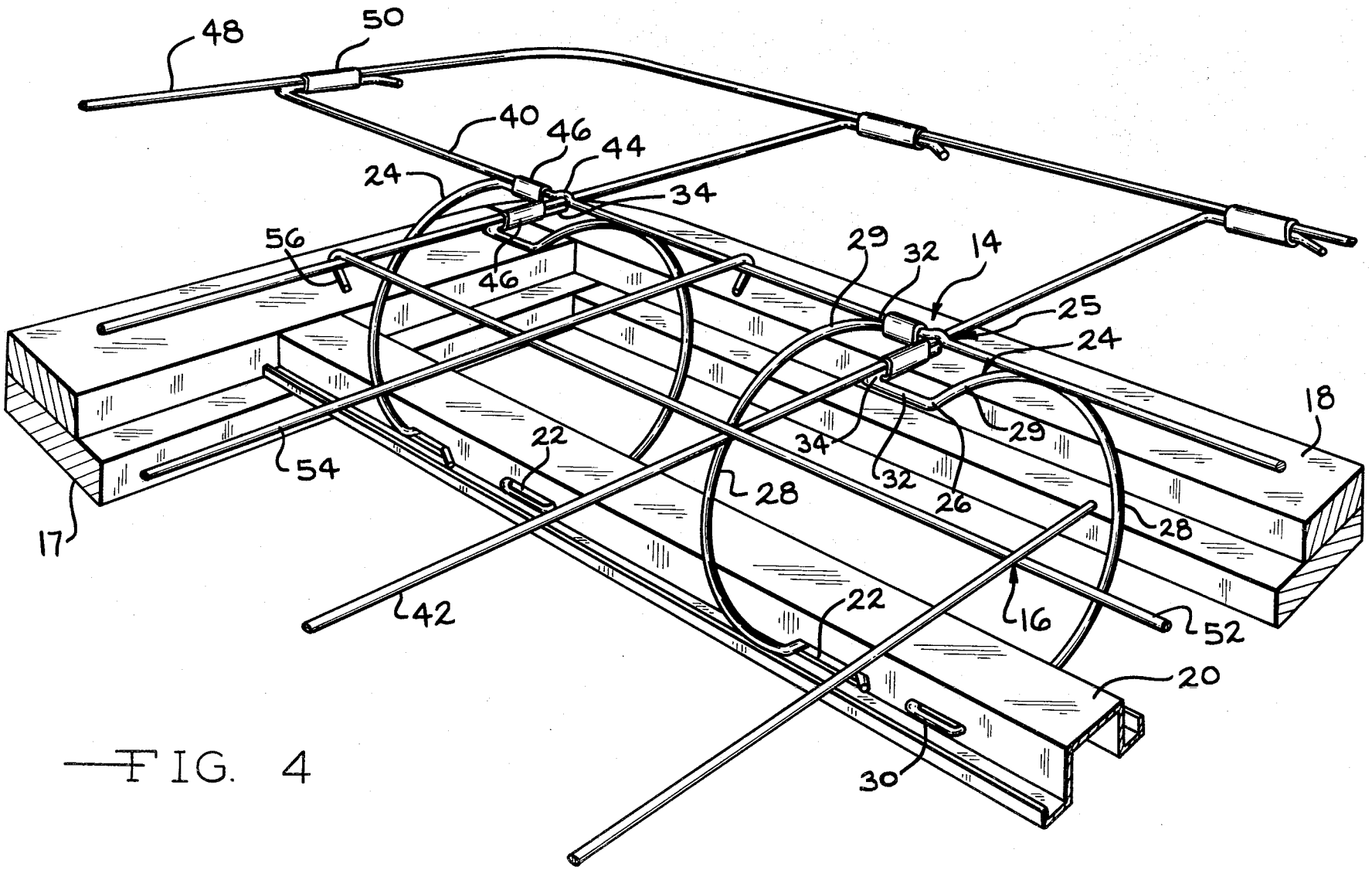
FIG. 4 is a fragmentary perspective view of a portion of the box spring assembly of this invention.

As shown in FIGS. 2 and 3, the wires 40 are provided with upwardly extending arcuate offsets or bends 44, sometimes called "notches", which are disposed on top of the wires 42 to enable the wires 40 and 42 to be located in the same horizontal plane. The wires 40 are aligned vertically with some of the torsion bars 32 and are supported on the top sides of those torsion bars 32. The wires 42 are aligned vertically with the connecting bars 34 and are supported on the top sides of the bars 34.

Conventional wrap-around clips are used to connect the wires 40 to the adjacent torsion bars 32 and to connect the wires 42 to the connecting bars 34. The notches 44 in the wires 40 enable the wires 40 to directly engage the top sides of the bars 32 so that all of the clips 46 connect pairs of vertically aligned and engaged wires. This facilitates direct transfer from the grid 25 to the springs 24 of bedding loads. It is apparent that different ones of the wires 40 and 42 can be notched so long as the result is a grid 25 in which all wires are in a common horizontal plane.

The deck also includes a border wire 48 secured by clips 50 to the ends of the wires 40 and 42.

The deck wires 40, 42, and 48 function not only to provide a horizontal mattress foundation, but also function to tie the springs 24 together so that they act cooperatively in resisting downwardly directed bedding loads. The entire spring assemblage 14 is formed of spring wires, a high carbon heat treated steel which has the "springiness" characteristic necessary to enable a spring to deflect under load and then return to its original position when the load is released. Spring wire usually has a carbon content in the range of 0.6–0.9 percent, and it is a percentage carbon in this general range that is referred to herein as "high carbon".

The grid unit 16 (FIG. 3) is formed of basic wire, a low carbon, non-heat treated steel that lacks the "springiness" characteristic of spring wire. Basic wire usually contains carbon in the range of 0.08–0.1 percent and a carbon content generally within this range is what is referred to herein as "low carbon".

The grid unit 16 consists of a plurality of straight first wires 52 that are substantially parallel to each other and to the deck wires 40, and a plurality of straight second wires 54 that are generally parallel to each other and to the deck wires 42. The wires 52 are spaced horizontally from each other and the wires 54 are similarly spaced horizontally from each other, the degree of spacing being related to the spaces between the wires 40 and 42 in the wire deck 25. At their intersections, the wires 52 and 54 are secured together, preferably by welding, and some of the wires 52 and 54 are formed at their ends with downwardly extending return bent-upon-themselves hook portions 56. The hook portions 56 have some of the deck wires 40 and 42 confined therein so as to restrain the grid unit 16 against horizontal shifting movement on the deck 25. The hooks 56 snap over the wires 40 and 42 which can be deflected to positions to one side of the hooks 56 during downward movement of the hooks 56, since the wires 40 and 42, because they are constructed of spring wire, will readily deflect back into confined positions within the hooks 56.

As shown in FIG. 1, the springs 24 are located at some of the intersections of the deck wires 40 and 42 and the deck wires 40 and 42 cooperate to form or define a continuous arrangement of rectangular spaces 58 in the deck 25. The grid wires 52 and 54 are arranged so as to bridge the spaces 58 and, in the illustrated embodiment of the invention, bisect the spaces 58 in mutually perpendicular directions. This is accomplished, in the illustrated form of the invention, by spacing the wires 52 and 54 in the grid 16 so that the spaces 60 formed therebetween are of the same size as the spaces 58 in the deck 25. The result, when the grid 16 is superimposed on the deck 25, as shown in FIG. 1, is a reduction in the size of the spaces 58 by a factor of four.

As shown in FIG. 2, the springs 24 are relatively narrow in width. This enables the use of as many or as few of the springs 24 as are desired in a particular box spring assembly. However, the fewer springs 24 that are used, the larger the spaces 58 in the wire deck. Further, even when the springs 24 are relatively closely spaced, there is sufficient space between the deck wires 40 and 42 to form deck spaces 58 of fairly large size. The advantage of this invention is that the basic wire grid is inexpensively formed and readily snapped over the deck 25 to bridge the spaces 58 and provide a mattress foundation which will uniformly resist bedding loads.

Thus, the box spring assembly 10 of this invention can be manufactured relatively inexpensively since all of the wire in the spring assemblage 14 and the grid unit 16 is effectively used without duplication of function. The springs 24 are readily manufactured in large numbers and the rest of the assembly consists principally of straight wire members that are easily manufactured. This enables economical manufacture of a variety of spring assemblies 10 having different comfort characteristics.

What is claimed:

1. In a box spring assembly which includes a generally rectangular horizontal frame and a wire spring assemblage mounted on said frame and extending upwardly therefrom, said assemblage including a plurality of straight wires arranged above the frame in a criss-cross fashion in which some wires are substantially parallel and spaced apart horizontally in one direction and other wires are substantially parallel and spaced apart horizontally in another direction substantially perpendicular to said one direction whereby to form a generally horizontal spring wire deck spaced above said frame and having a continuous arrangement of rectangular spaces formed by said wires; a grid unit formed of basic wire and supported on the top side of said deck for the purpose of bridging said spaces, said grid unit comprising a plurality of straight first wires that are substantially parallel to said some deck wires and are spaced apart horizontally and a plurality of straight second wires that are substantially parallel to said other deck wires and are spaced apart horizontally, said grid wires being secured to each other to form said grid unit and being located to bridge said spaces in mutually perpendicular directions, and downwardly extending return bent-upon-themselves hook portions on the ends of at least some of said grid wires, said hook portions having some of said deck wires confined therein so as to restrain said grid unit against horizontal shifting movement on said deck.

2. The structure according to claim 1 further including a plurality of vertically yieldable, substantially identical springs mounted on said frame and arranged in a supporting relation with said deck so as to form the sole support for said deck on said frame.

3. The structure according to claim 2 wherein said grid unit wires are arranged to substantially bisect said deck spaces in mutually perpendicular directions.

4. In a box spring assembly which includes a generally rectangular horizontal frame and a wire spring assemblage mounted on said frame and extending upwardly therefrom, said assemblage including a plurality of straight wires arranged above the frame in a criss-cross fashion in which some wires are substantially parallel and spaced apart horizontally in one direction and other wires are substantially parallel and spaced apart horizontally in another direction substantially perpendicular to said one direction whereby to form a generally horizontal spring wire deck spaced above said frame and having a continuous arrangement of rectangular spaces formed by said wires, and a plurality of wire springs arranged in a supporting relation with said straight spring wires, said wire springs being supported on said frame at predetermined locations corresponding to the locations at which a number of said some wires intersect said other wires, said springs being engaged with said spring wires at said locations; a grid unit formed of basic wire and supported on the top side of said deck for the purpose of bridging said spaces, said grid unit comprising a plurality of straight first wires that are substantially parallel to said some deck wires and are spaced apart horizontally and a plurality of straight second wires that are substantially parallel to said other deck wires and are spaced apart horizontally, said grid wires being secured to each other to form said grid unit and being located to bridge said spaced in mutually perpendicular directions, and means connecting said grid unit to said deck wires so that grid unit is restrained against horizontal shifting on said deck wires.

5. The structure according to claim 4 wherein said connecting means comprises downwardly extending hook portions on the ends of at least some of said grid wires, said hook portions being snapped over some of said deck wires so as to restrain said grid unit against horizontal shifting movement on said deck.

6. The structure according to claim 5 wherein each of said springs includes a wire body having side-by-side arcuate portions that extend vertically and are bendable downwardly in response to the application of bedding loads to said box spring assembly.

7. The structure according to claim 6 wherein each of said springs also includes a pair of torsion bars formed integral with the upper ends of said side-by-side portions and a connecting bar formed integral with and extending between said torsion bars, and means securing the connecting bar and one torsion bar in each of said springs to a pair of said straight spring wires at the intersection thereof in said deck.

* * * * *